US008585034B1

(12) United States Patent
Mahoney et al.

(10) Patent No.: US 8,585,034 B1
(45) Date of Patent: Nov. 19, 2013

(54) RECEIVER SUPPLY USING CUT SHEET MEDIA

(75) Inventors: Kevin T. Mahoney, Spencerport, NY (US); Robert Fredric Mindler, Churchville, NY (US)

(73) Assignee: Kodak Alaris Inc., Rochester, NY (US)

( * ) Notice: Subject to any disclaimer, the term of this patent is extended or adjusted under 35 U.S.C. 154(b) by 0 days.

(21) Appl. No.: 13/598,100

(22) Filed: Aug. 29, 2012

(51) Int. Cl.
*G03G 15/00* (2006.01)

(52) U.S. Cl.
USPC ..... 271/3.03; 271/3.01; 271/162; 399/402

(58) Field of Classification Search
USPC ..... 271/3.01, 3.03, 3.04, 3.05, 3.08, 145, 271/164, 162; 399/401, 402
See application file for complete search history.

(56) References Cited

U.S. PATENT DOCUMENTS

| | | | | |
|---|---|---|---|---|
| 4,924,275 | A * | 5/1990 | Nelson | 399/401 |
| 2004/0066523 | A1* | 4/2004 | Gardiner | 358/1.5 |
| 2012/0080834 | A1* | 4/2012 | Shiohara et al. | 271/9.04 |

* cited by examiner

*Primary Examiner* — Jeremy R Severson

(57) ABSTRACT

A method for handling cut sheet media in a receiver supply media cassette comprising providing a media tray with a removable media receptacle in the receiver supply media cassette. The media tray is attached to the imaging apparatus to feed the cut sheet media from a first compartment of the removable media receptacle to the imaging apparatus to print a first image on a first side of the fed cut sheet media and receive the printed cut sheet media from the imaging apparatus into a second compartment of the removable media receptacle. The removable media receptacle is flipped the cut sheet media is fed to the imaging apparatus to print a second image on a second side of the fed cut sheet media. The method further includes receiving the printed cut sheet media from the imaging apparatus into the first compartment of the removable media receptacle.

5 Claims, 11 Drawing Sheets

RECEIVER SUPPLY USING CUT SHEET MEDIA

CROSS REFERENCE TO RELATED APPLICATIONS

Reference is made to commonly-assigned copending U.S. patent application Ser. No. 13/597,722, filed concurrently herewith, entitled "Method For Handling Cut Sheet Media", by Mahoney et al, the disclosure of which is incorporated herein.

FIELD OF THE INVENTION

This invention pertains to a receiver supply media cassette that uses cut sheet media.

BACKGROUND OF THE INVENTION

In thermal dye sublimation printing, it is generally well known to render images by heating and pressing one or more donor materials such as a colorant (e.g., a dye) or other coating against a receiver medium having a colorant receiving layer. The heat is generally supplied by a thermal print head having an array of heating elements. The donor materials are typically provided in sized donor patches on a movable web known as a donor ribbon. The donor patches are organized on the ribbon into donor sets; each set containing all of the donor patches that are to be used to record an image on the receiver web. For full color images, multiple color dye patches can be used, such as yellow, magenta, and cyan donor dye patches. Arrangements of other color patches can be used in like fashion within a donor set. Additionally, each donor set can include an overcoat or sealant layer.

Thermal printers offer a wide range of advantages in photographic printing including the provision of truly continuous tone scale variation and the ability to deposit, as a part of the printing process a protective overcoat layer to protect the images formed thereby from mechanical and environmental damage. Accordingly, many photographic kiosks and home photo printers currently use thermal printing technology.

Some thermal printing systems are adapted to print on individual sheets of receiver media. Thermal printing systems that are used for large volume applications (e.g., photographic kiosks) commonly utilize roll-fed receiver media.

Conventionally, thermal printers have been adapted for producing single-sided images and have used receiver media having a colorant receiving layer coated on only one side of a substrate. There are a variety of applications (e.g., photo books and photo calendars) where it is desirable to print on both sides of the receiver media to provide double-sided images. Some prior art approaches for printing on both sides of the receiver media have utilized two printing stations, each including its own thermal print head and donor ribbon, one to print each side of the image. This adds significant cost and size to the thermal printer design. Other prior art approaches have utilized large and cumbersome mechanisms within the thermal printer to reposition the receiver media supply roll after the first-side image has been printed in order to print the second-side image. This approach also adds significant cost and size to the thermal printer design.

There remains a need in the art for a duplex thermal printer that is low-cost and compact.

SUMMARY OF THE INVENTION

The present invention is directed to providing a receiver supply media cassette for a thermal printer. The receiver supply media cassette is adapted to hold cut sheet media and enables the thermal printer to form images on both sides of the cut sheet media.

A method for handling cut sheet media in a receiver supply media cassette, comprises:

- providing the receiver supply media cassette that includes a media tray with a removable media receptacle to hold the cut sheet media, wherein the removable media receptacle has a first compartment to hold cut sheet media to be fed into an imaging apparatus, and a second compartment to receive cut sheet media from the imaging apparatus;
- attaching the media tray with the removable media receptacle to the imaging apparatus;
- feeding the cut sheet media from the first compartment of the removable media receptacle to the imaging apparatus;
- using the imaging apparatus to print a first image on a first side of the fed cut sheet media;
- receiving the printed cut sheet media from the imaging apparatus into the second compartment of the removable media receptacle;
- flipping the removable media receptacle;
- feeding the cut sheet media from the second compartment of the removable media receptacle to the imaging apparatus;
- using the imaging apparatus to print a second image on a second side of the fed cut sheet media; and
- receiving the printed cut sheet media from the imaging apparatus into the first compartment of the removable media receptacle.

An advantage of the present invention is that it provides a low cost compact solution to producing duplex prints using a thermal printer without requiring costly redesign of the printer. Another advantage of the present invention is that a user does not directly handle the receiver media in any stage of the process, resulting in an artifact-free duplex print.

It is to be understood that the attached drawings are for purposes of illustrating the concepts of the invention and may not be to scale.

DETAILED DESCRIPTION OF THE INVENTION

The invention is inclusive of combinations of the aspects of the present invention described herein. References to "a particular aspect" and the like refer to features that are present in at least one aspect of the invention. Separate references to "an aspect" or "particular aspects" or the like do not necessarily refer to the same aspect or aspects; however, such aspects are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 1:
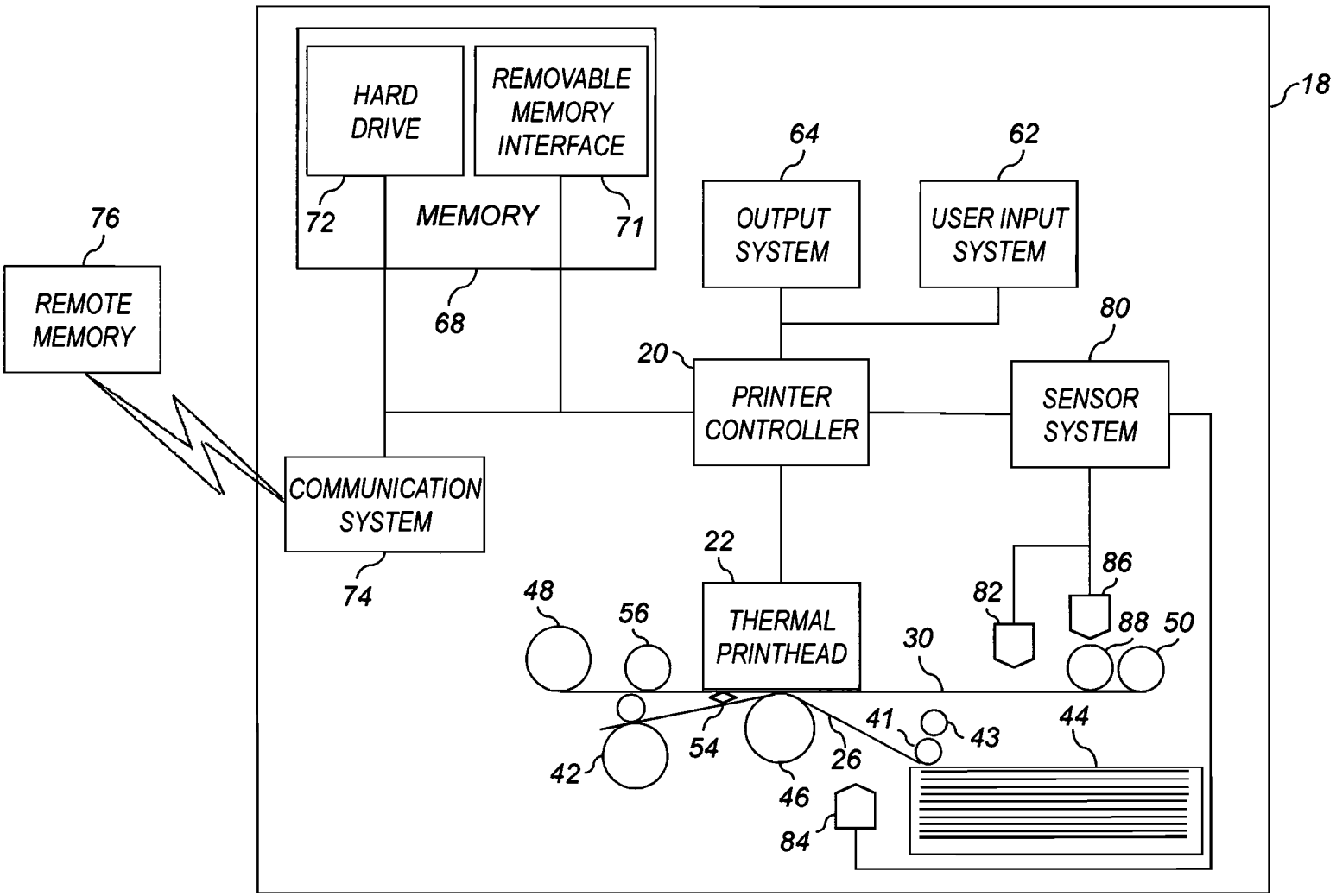
FIG. 1 shows a system diagram for an exemplary thermal printing system that can be used in practicing the present invention.

FIG. 1 shows a system diagram for an exemplary thermal printer 18 that can be used to practice the present invention. As shown in FIG. 1, thermal printer 18 has a printer controller 20 that causes a thermal print head 22 to record images onto receiver media 26 by applying heat and pressure to transfer material from a donor ribbon 30 to receiver media 26. The receiver media 26 includes a dye receiving layer coated on a substrate. As used herein, the term "receiver media" is used synonymously with the terms "thermal imaging receiver" and "thermal media." Similarly, the term "donor ribbon" is used synonymously with the terms "thermal donor" and "donor web."

Printer controller 20 can include, but is not limited to: a programmable digital computer, a programmable microprocessor, a programmable logic controller, a series of electronic circuits, a series of electronic circuits reduced to the form of an integrated circuit, or a series of discrete components. According to an aspect of the invention shown in FIG. 1, printer controller 20 also controls receiver pick rollers 41, a receiver drive roller 42, receiver exit rollers 43, a donor ribbon take-up roll 48, and a donor ribbon supply roll 50; which are each motorized for rotation on command of the printer controller 20 to effect movement of receiver media 26 and donor ribbon 30.

Figure 2:
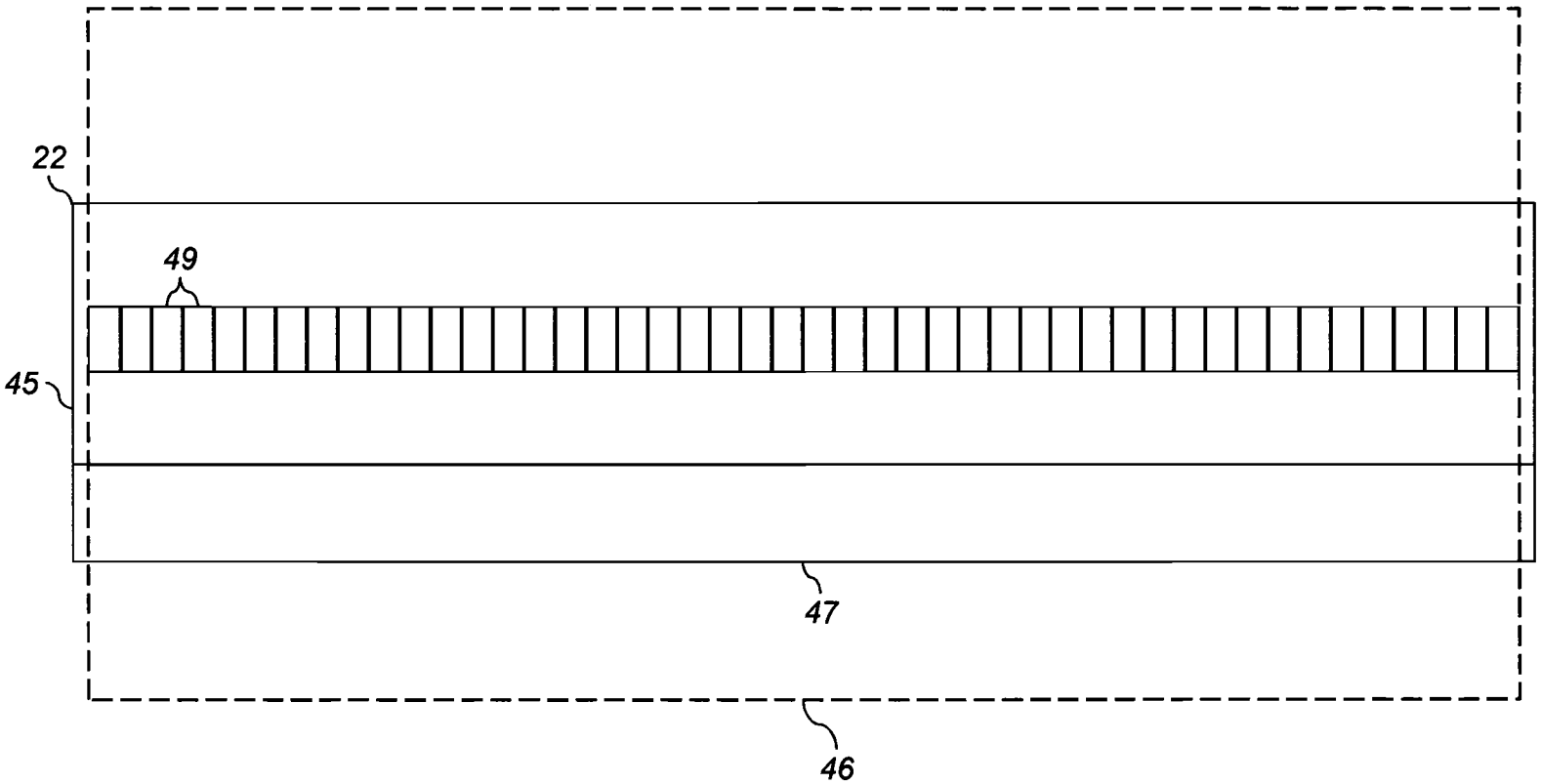
FIG. 2 is a diagram showing a bottom view of a thermal printhead used in FIG. 1.

FIG. 2 shows a bottom view according to one aspect of a typical thermal print head 22 with an array of thermal resistors 49 fabricated in a ceramic substrate 45. A heat sink 47, typically in the form of an aluminum backing plate, is fixed to a side of the ceramic substrate 45. Heat sink 47 rapidly dissipates heat generated by the thermal resistors 49 during printing. As shown in FIG. 2, the thermal resistors 49 are arranged in a linear array extending across the width of platen roller 46 (shown in phantom). Such a linear arrangement of thermal resistors 49 is commonly known as a heat line or print line. However, other non-linear arrangements of thermal resistors 49 can be used in various aspects of the present invention. Further, it will be appreciated that there are a wide variety of other arrangements of thermal resistors 49 and thermal print heads 22 that can be used in conjunction with the present invention.

The thermal resistors 49 are adapted to generate heat in proportion to an amount of electrical energy that passes through thermal resistors 49. During printing, printer controller 20 transmits signals to a circuit board (not shown) to which thermal resistors 49 are connected, causing different amounts of electrical energy to be applied to thermal resistors 49 so as to selectively heat donor ribbon 30 in a manner that is intended to cause donor material to be applied to receiver media 26 in a desired manner.

Figure 3A:
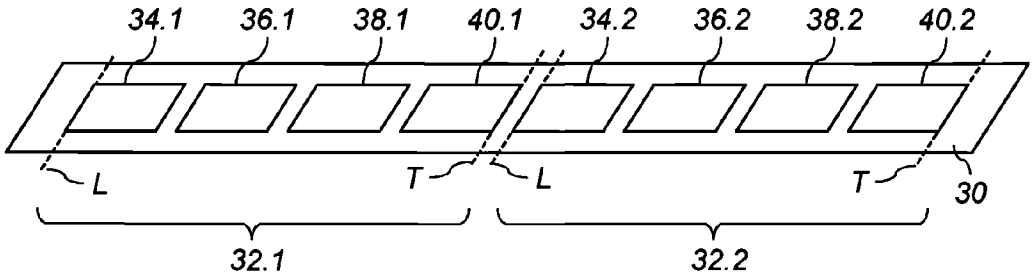
FIG. 3A is a diagram illustrating a donor ribbon having four different donor patches that can be used with the system shown in FIG. 1.
Figure 3B:
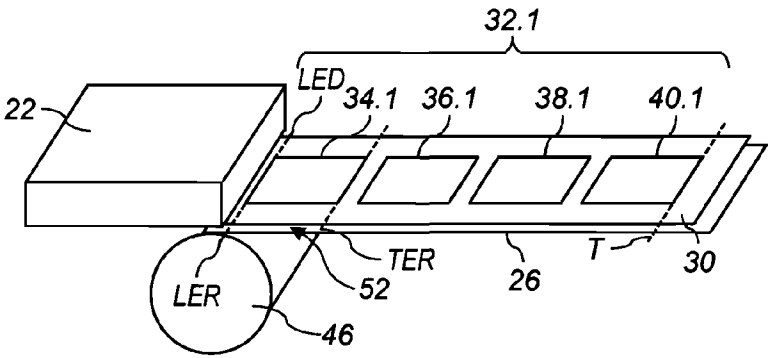
FIGS. 3B-3C illustrate a printing operation using the system shown in FIG. 1.

As is shown in FIG. 3A, donor ribbon 30 comprises a first donor patch set 32.1 having a yellow donor patch 34.1, a magenta donor patch 36.1, a cyan donor patch 38.1 and a clear donor patch 40.1; and a second donor patch set 32.2 having a yellow donor patch 34.2, a magenta donor patch 36.2, a cyan donor patch 38.2 and a clear donor patch 40.2. Each donor patch set 32.1 and 32.2 has a patch set leading edge L and a patch set trailing edge T. In order to provide a full color image with a clear protective coating, the four patches of a donor patch set; are printed, in registration with each other, onto a common image receiving area 52 of receiver media 26 shown in FIG. 3B. The printer controller 20 (FIG. 1) provides variable electrical signals in accordance with input image data to the thermal resistors 49 (FIG. 2) in the thermal print head 22 in order to print an image onto the receiver media 26. Each color is successively printed as the receiver media 26 and the donor ribbon move from right to left as seen by the viewer in FIG. 3B.

During printing, the printer controller 20 raises thermal print head 22 and actuates donor ribbon supply roll 50 (FIG. 1) and donor ribbon take-up roll 48 (FIG. 1) to advance a leading edge L of the first donor patch set 32.1 to the thermal print head 22. In the embodiment illustrated in FIGS. 3A-3C, leading edge L for first donor patch set 32.1 is the leading edge of yellow donor patch 34.1. As will be discussed in greater detail below, the position of this leading edge L can be determined by using a position sensor to detect an appropriate marking indicia on donor ribbon 30 that has a known position relative to the leading edge of yellow donor patch 34.1 or by directly detecting the leading edge of yellow donor patch 34.1.

Printer controller 20 also actuates receiver pick rollers 41 (FIG. 1) to pick cut sheet receiver from receiver supply cassette 44 (FIG. 1) into drive roller 42 (FIG. 1). Printer controller 20 also actuates drive roller 42 (FIG. 1), so that image receiving area 52 of receiver media 26 is positioned with respect to the thermal print head 22. In the embodiment illustrated, image receiving area 52 is defined by a receiving area leading edge LER and a receiving area trailing edge TER on receiver media 26. Donor ribbon 30 and receiver media 26 are positioned so that donor patch leading edge LED of yellow donor patch 34.1 is registered at thermal print head 22 with receiving area leading edge LER of image receiving area 52. Printer controller 20 then causes a motor or other conventional structure (not shown) to lower thermal print head 22 so that a lower surface of donor ribbon 30 engages receiver media 26 which is supported by platen roller 46. This creates a pressure holding donor ribbon 30 against receiver media 26.

Printer controller 20 then actuates receiver drive roller 42 (FIG. 1), donor ribbon take-up roll 48 (FIG. 1), and donor ribbon supply roll 50 (FIG. 1) to move receiver media 26 and donor ribbon 30 together past the thermal print head 22. Concurrently, printer controller 20 selectively operates thermal resistors 49 (FIG. 2) in thermal print head 22 to transfer donor material from yellow donor patch 34.1 to receiver media 26.

Figure 3C:
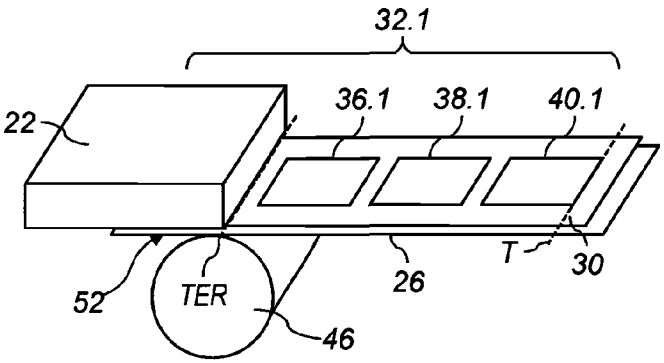

As donor ribbon 30 and receiver media 26 leave the thermal print head 22, a peel member 54 (FIG. 1) separates donor ribbon 30 from receiver media 26. Donor ribbon 30 continues over idler roller 56 (FIG. 1) toward the donor ribbon take-up roll 48. As shown in FIG. 3C, printing continues until the receiving area trailing edge TER of image receiving area 52 of receiver media 26 reaches the printing zone between the thermal print head 22 and the platen roller 46. The printer controller 20 then adjusts the position of donor ribbon 30 and receiver media 26 using a predefined pattern of movements so that a leading edge of each of the next donor patches (i.e., magenta donor patch 36.1) in the first donor patch set 32.1 are brought into alignment with receiving area leading edge LER of image receiving area 52 and the printing process is repeated to transfer further material to the image receiving area 52. This process is repeated for each donor patch thereby forming the complete image.

Returning to a discussion of FIG. 1, the printer controller 20 operates the thermal printer 18 based upon input signals from a user input system 62, an output system 64, a memory 68, a communication system 74, and sensor system 80. The user input system 62 can comprise any form of transducer or other device capable of receiving an input from a user and converting this input into a form that can be used by printer controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such user input systems. An output system 64, such as a display or a speaker, is optionally provided and can be used by printer controller 20 to provide human perceptible signals (e.g., visual or audio signals) for feedback, informational or other purposes.

Data including, but not limited to, control programs, digital images and metadata can also be stored in memory 68. Memory 68 can take many forms and can include without limitation conventional memory devices including solid state, magnetic, optical or other data storage devices. In FIG. 1, memory 68 is shown having a removable memory interface 71 for communicating with removable memory (not shown) such as a magnetic, optical or magnetic disks. The memory 68 is also shown having a hard drive 72 that is fixed with thermal printer 18 and a remote memory 76 that is external to printer controller 20 such as a personal computer, computer network or other imaging system.

As shown in FIG. 1, printer controller 20 interfaces with a communication system 74 for communicating with external devices such as remote memory 76. The communication system 74 can include for example, a wired or wireless network interface that can be used to receive digital image data and other information and instructions from a host computer or network (not shown).

A sensor system 80 includes circuits and systems that are adapted to detect conditions within thermal printer 18 and, optionally, in the environment surrounding thermal printer 18, and to convert this information into a form that can be used by the printer controller 20 in governing printing operations. Sensor system 80 can take a wide variety of forms depending on the type of media therein and the operating environment in which thermal printer 18 is to be used.

As shown in FIG. 1, sensor system 80 includes an optional donor position sensor 82 that is adapted to detect the position of donor ribbon 30, and a receiver position sensor 84 that is adapted to detect a position of the receiver media 26. The printer controller 20 cooperates with donor position sensor 82 to monitor the donor ribbon 30 during movement thereof so that the printer controller 20 can detect one or more conditions on donor ribbon 30 that indicate a leading edge of a donor patch set. In this regard, the donor ribbon 30 can be provided with markings or other optically, magnetically or electronically sensible indicia between each donor patch set (e.g., donor patch set 32.1) or between donor patches (e.g., donor patches 34.1, 36.1, 38.1, and 40.1). Where such markings or indicia are provided, donor position sensor 82 is provided to sense these markings or indicia, and to provide signals to controller 20. The printer controller 20 can use these markings and indicia to determine when the donor ribbon 30 is positioned with the leading edge of the donor patch set at thermal print head 22. In a similar way, printer controller 20 can use signals from receiver position sensor 84 to monitor the position of the receiver media 26 to align receiver media 26 during printing. Receiver position sensor 84 can be adapted to sense markings or other optically, magnetically or electronically sensible indicia between each image receiving area of receiver media 26.

During a full image printing operation, the printer controller 20 causes donor ribbon 30 to be advanced in a predetermined pattern of distances so as to cause a leading edge of each of the donor patches (e.g., donor patches 34.1, 36.1, 38.1, and 40.1) to be properly positioned relative to the image receiving area 52 at the start each printing process. The printer controller 20 can optionally be adapted to achieve such positioning by precise control of the movement of donor ribbon 30 using a stepper type motor for motorizing donor ribbon take-up roll 48 or donor ribbon supply roll 50 or by using a movement sensor 86 that can detect movement of donor ribbon 30. In one example, a follower wheel 88 is provided that engages donor ribbon 30 and moves therewith. Follower wheel 88 can have surface features that are optically, magnetically or electronically sensed by the movement sensor 86. According to one aspect of the present invention, the follower wheel 88 that has markings thereon indicative of an extent of movement of donor ribbon 30 and the movement sensor 86 includes a light sensor that can sense light reflected by the markings. According to other aspects of the present invention, perforations, cutouts or other routine and detectable indicia can be incorporated onto donor ribbon 30 in a manner that enables the movement sensor 86 to provide an indication of the extent of movement of the donor ribbon 30.

Optionally, donor position sensor 82 can be adapted to sense the color of donor patches on donor ribbon 30 and can provide color signals to controller 20. In this case, the printer controller 20 can be programmed or otherwise adapted to detect a color that is known to be found in the first donor patch in a donor patch set (e.g., yellow donor patch 34.1 in donor patch set 32.1). When the color is detected, the printer controller 20 can determine that the donor ribbon 30 is positioned proximate to the start of the donor patch set.

Figure 4:
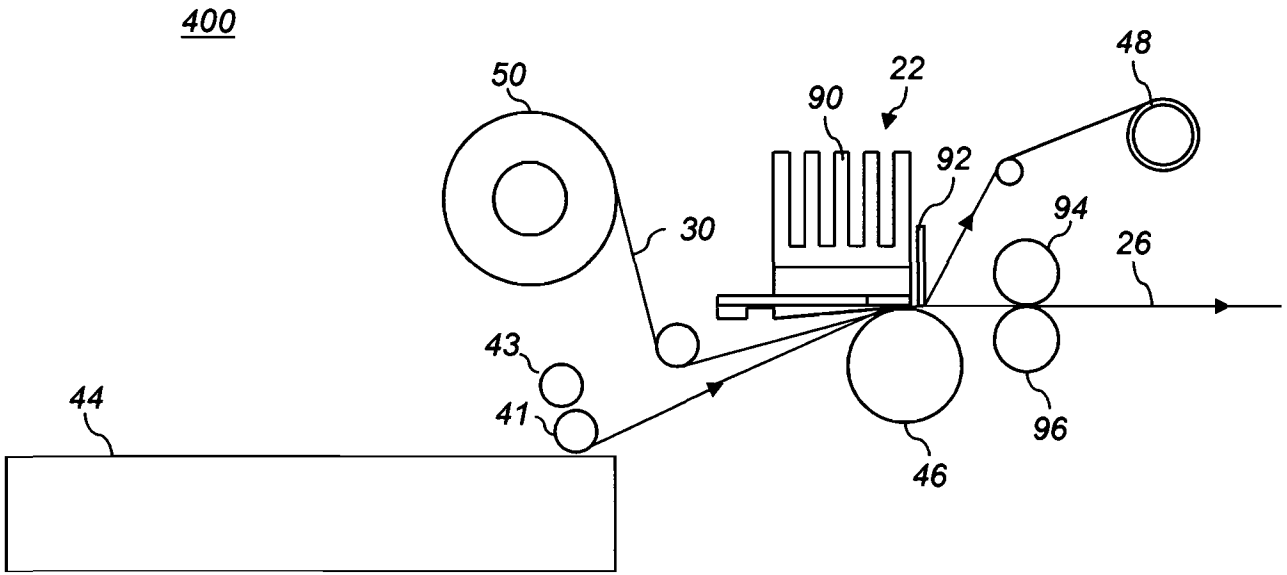
FIG. 4 is a diagram illustrating components of the thermal printing system shown in FIG. 1.

FIG. 4 shows additional details for components of a thermal printing system 400 according to an aspect of the present invention. Donor ribbon supply roll 50 supplies donor ribbon 30, which is received by take-up roll 48. A receiver supply media cassette 44 supplies cut sheet receiver media 26. Receiver media 26 and donor ribbon 30 are merged together between platen roller 46 thermal print head 22, which includes a heat sink 90 and a peel member 92.

Subsequent to the thermal print head 22 transferring donor material from the donor ribbon 30 to the receiver media 26, the peel member 92 separates the donor ribbon 30 from the receiver media 26. The donor ribbon 30 continues to travel on to the donor ribbon take-up roll 48, while the receiver media 26 travels between a pinch roller 94 and a capstan roller 96 that form a nip.

There are many applications where it is desirable to print images on both sides of the receiver media 26. For example, photo calendars and photo book pages generally have photographs or other content (e.g., text and graphics) printed on both sides of each page. To print duplex thermal prints, the receiver media 26 should have dye receiving layers coated on both sides of a substrate. Various arrangements can then be used to transfer dye onto both sides of the receiver media 26.

Figure 5:
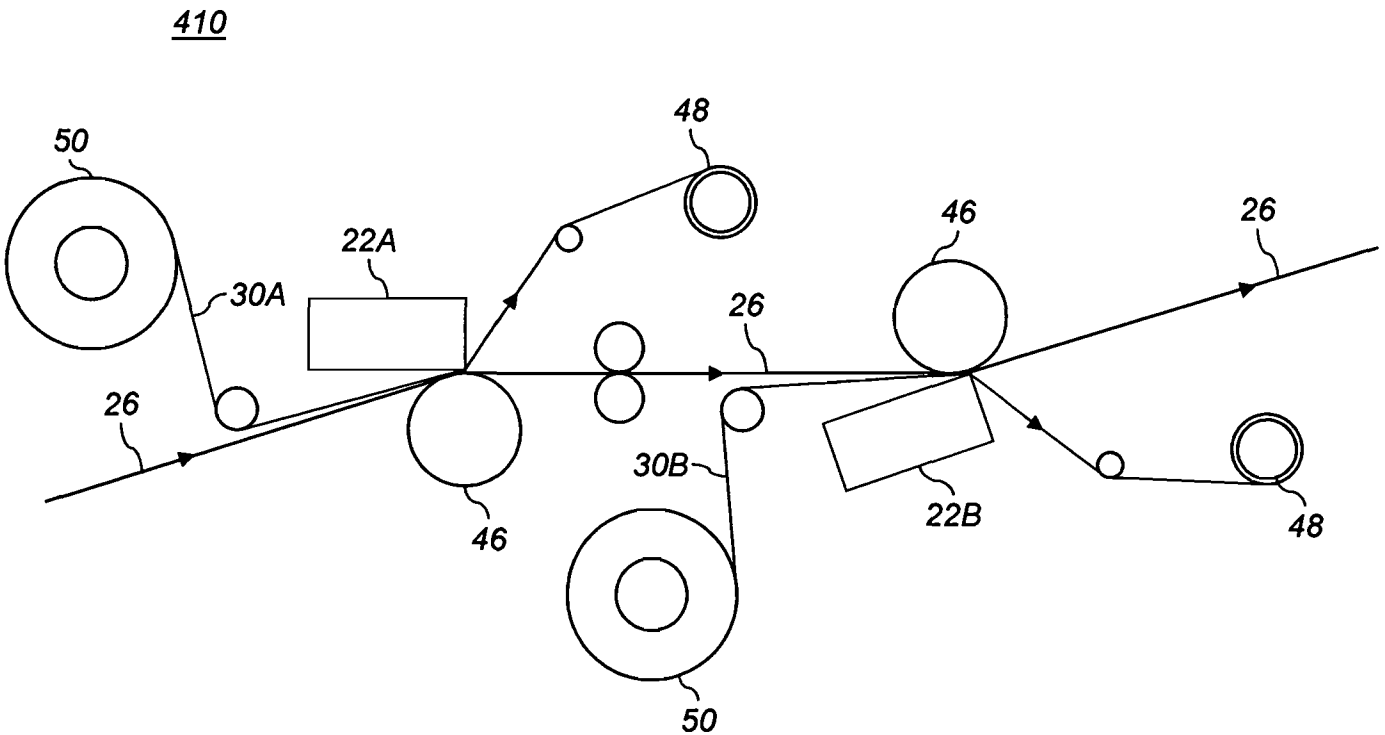
FIG. 5 is a diagram illustrating a duplex thermal printing system using two thermal printheads.

FIG. 5 shows one arrangement that can be used for a duplex thermal printing system 410. In this configuration, the main printing components shown in the arrangement of FIG. 4 are duplicated, with one being arranged to print on each side of the receiver media 26. A first thermal print head 22A transfers dye from a first donor ribbon 30A onto a first side of the receiver media 26, and a second thermal print head 22B transfers dye from a second donor ribbon 30B onto a second side of the receiver media 26. This configuration has the advantage that two-sided images can be printed without complex paper handling mechanism. The main disadvantage of this approach is that it adds significant cost to the printer since it doubles the number of thermal print heads 22A and 22B and other associated components. It also requires a longer media path, and therefore increases the printer size accordingly. Another disadvantage is that two rolls of donor ribbon 30A and 30B must be used, which means that the printer operator will need to stock larger numbers of rolls, and if the donor ribbons 30A and 30B are used at different rates they may need to service the printer more frequently to reload donor ribbon when one of the rolls is used up.

Figure 6:
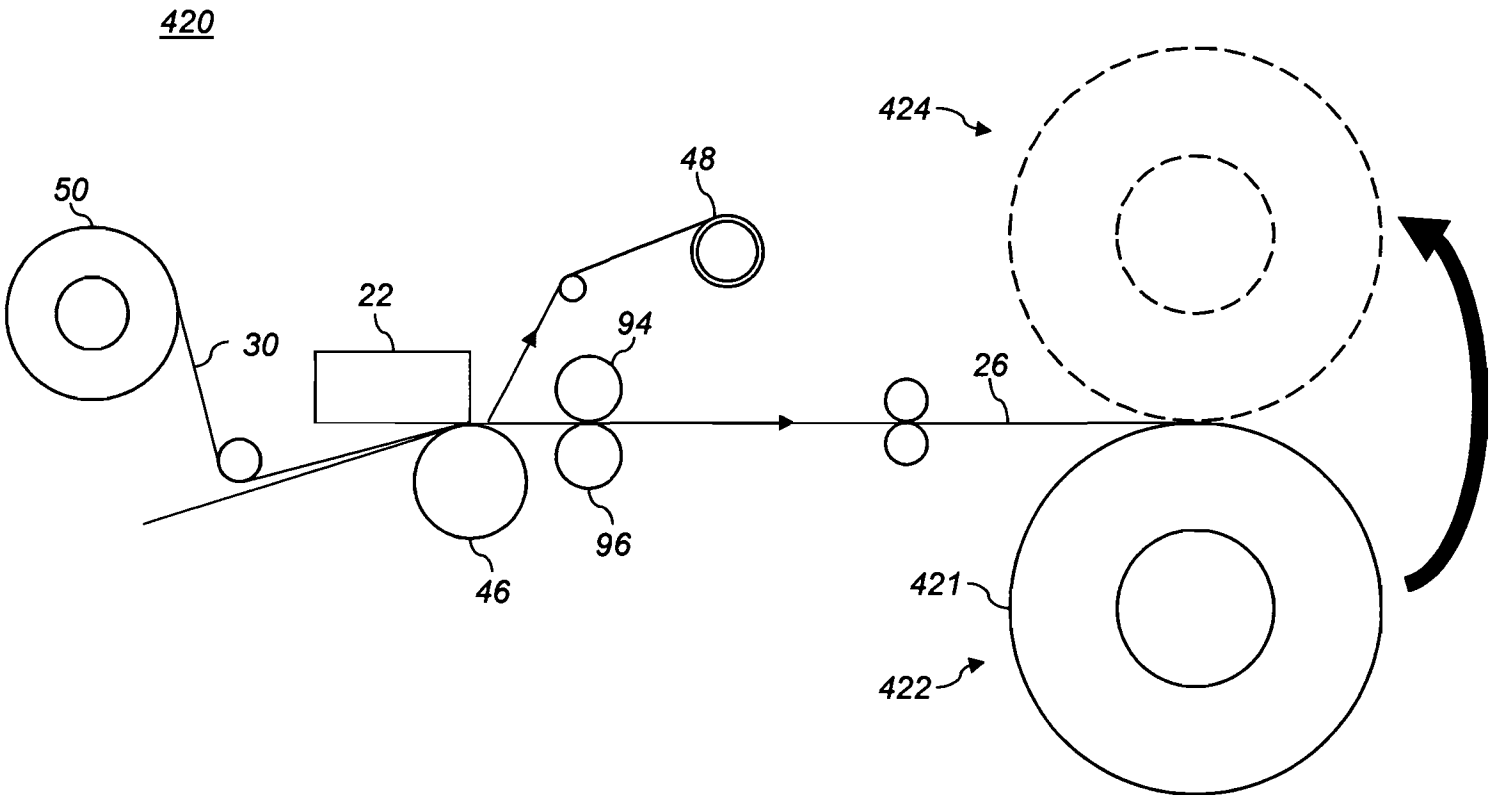
FIG. 6 is a diagram illustrating an alternate duplex thermal printing system that includes a turning mechanism for repositioning the receiver supply roll.

FIG. 6 shows another arrangement that can be used for a duplex thermal printing system 420. In this configuration, which is similar to that used in the KODAK D4000 Duplex Photo Printer, the receiver supply roll 421 is provided with a turning mechanism (not shown) that enables it to be pivoted from a first position 422 to a second position 424. After the first side of the image has been printed using the thermal print head, the receiver media 26 is wound back onto the receiver supply roll 421. The receiver supply roll 421 is then pivoted into the second position 424 and the receiver media 26 is rethreaded between the thermal print head 22 and the platen roller 46. The opposite side of the receiver media will now be facing the thermal print head 22 so that the second side of the image can be printed. The main disadvantage of this approach is that the turning mechanism for the receiver supply roll 421 adds significant cost to the printer. Since the receiver supply roll 421 is typically quite large relative to the size of the printer, the printer size must also be increased to provide space to position the receiver supply roll 421 into the second position 424.

Figure 7:
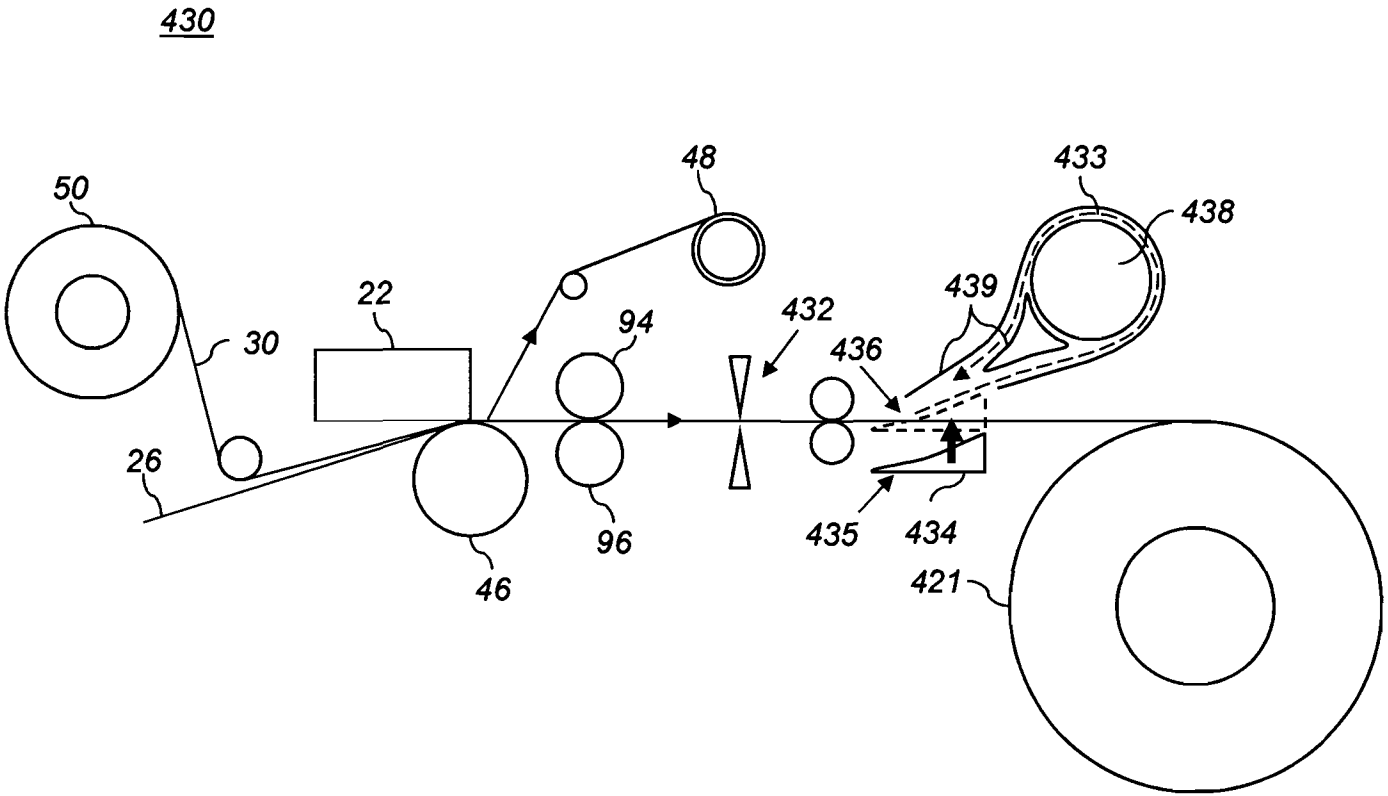
FIG. 7 is a diagram illustrating an alternate duplex thermal printing system using a turn roller.

FIG. 7 shows a duplex thermal printing system 430 that includes a turning mechanism for turning over the receiver media 26. In this configuration a cutter 432 is provided that can be used to cut the receiver media 26 after the first side of the image has been printed. A diverter 434 is then repositioned from a first position 435 to a second position 436 in order to feed cut receiver media 433 into the turning mechanism that includes a turn roller 438 and guides 439. The cut receiver media 433 is then rethreaded between the thermal print head 22 and the platen roller 46 where the opposite side of the cut receiver media 433 will now be facing the thermal print head 22 so that the second side of the image can be printed. To keep the size of the printer as small as possible, it is desirable for the turn roller 438 to have a relatively small radius. However, if it is made too small it can have the undesirable affect of introducing curl into the cut receiver media 433 and creating scratches and other undesirable markings on the printed surface.

Figure 8:
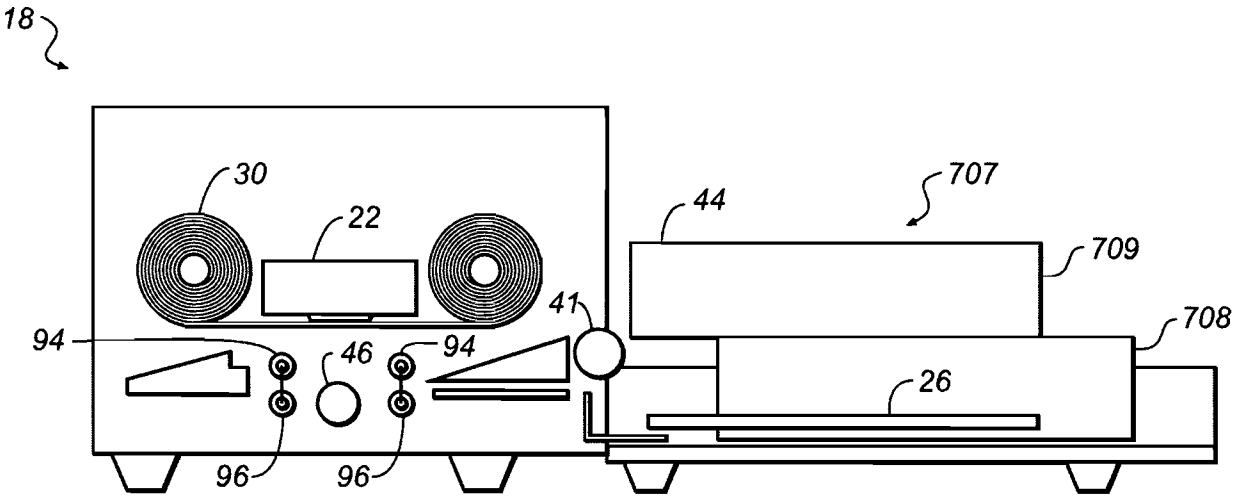
FIG. 8 is a diagram illustrating a thermal printer capable of printing duplex prints using a receiver supply media cassette comprising a media tray and a removable media receptacle.

FIG. 8 shows a diagram illustrating the thermal printer 18 according to an aspect of the present invention. FIG. 8 shows the receiver supply media cassette 44 adapted to hold cut sheet media 26 attached to the thermal printer 18 to form images on both sides of the cut sheet media 26. The receiver supply media cassette 44 includes a media tray 910 and a removable media receptacle 707. Details of the media tray 910 and the removable media receptacle 707 are shown in FIGS. 9 and 10 respectively and described later in the specification.

As shown in FIG. 8, cut sheet media 26 is placed into a first compartment 708 of the removable media receptacle 707. The cut sheet media 26 is then picked from the first compartment 708 by the pick roller 41. The pick roller 41 feeds the cut sheet media 26 into a nip formed by a first capstan roller 96 and a first pinch roller 94, past the platen roller 46 until the receiving area trailing edge TER is clamped into a nip formed by a second capstan roller 96 and a second pinch roller 94. After the cut sheet media 26 is clamped at the receiving area trailing edge TER, it is fed back to the platen roller 46. The print head 22 applies heat and pressure to the donor ribbon 30, the cut sheet media 26, and the platen roller 46 to form a first image on the first side of the cut sheet media 26 as described above in the specification. After the first image has been formed on the cut sheet media 26, the cut sheet media 26 is fed from the thermal printer 18 into the second compartment 709 of the removable media receptacle 707. According to an aspect of the present invention, a user can flip the removable media receptacle 707 in the receiver supply media cassette 44 by depressing a flexible member 1010 to hold the cut sheet media 26 in place in the second compartment 709. Once the removable media receptacle 707 has been flipped, the pick roller 41 feeds cut sheet media 26 to the thermal printer 18 to form a second image on the second side of the cut sheet media 26 as described above.

Figure 9:
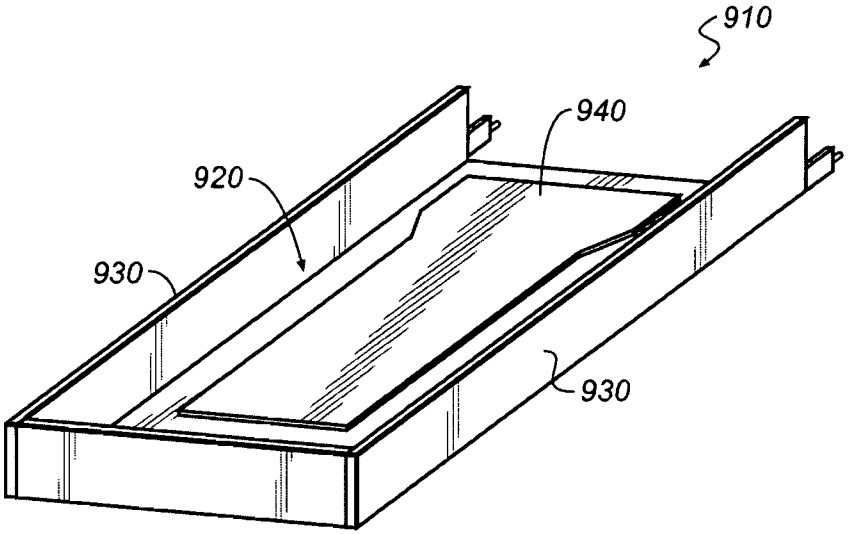
FIG. 9 is a pictorial illustrating the media tray of the receiver supply media cassette.

As shown in FIG. 9, the receiver supply media cassette 44 includes the media tray 910 having a cut sheet receiving well 920 comprising at least two side walls 930, and a ramp 940 disposed between the two side walls 930. The removable media receptacle 707 adapted to fit inside the cut sheet receiving well 920 of the media tray 910 is shown in FIGS. 8 and 10. The removable media receptacle 707 includes a first compartment 708 adapted to hold cut sheet media 26 to be fed to the thermal printer 18 and a second compartment 709 adapted to receive cut sheet media 26 from the thermal printer 18. The removable media receptacle 707 is flipped inside the cut sheet receiving well 920 of the media tray 910 after images have been formed on the first side of the cut sheet media 26 so that images can be formed on the second side of the cut sheet media 26.

Figure 10:
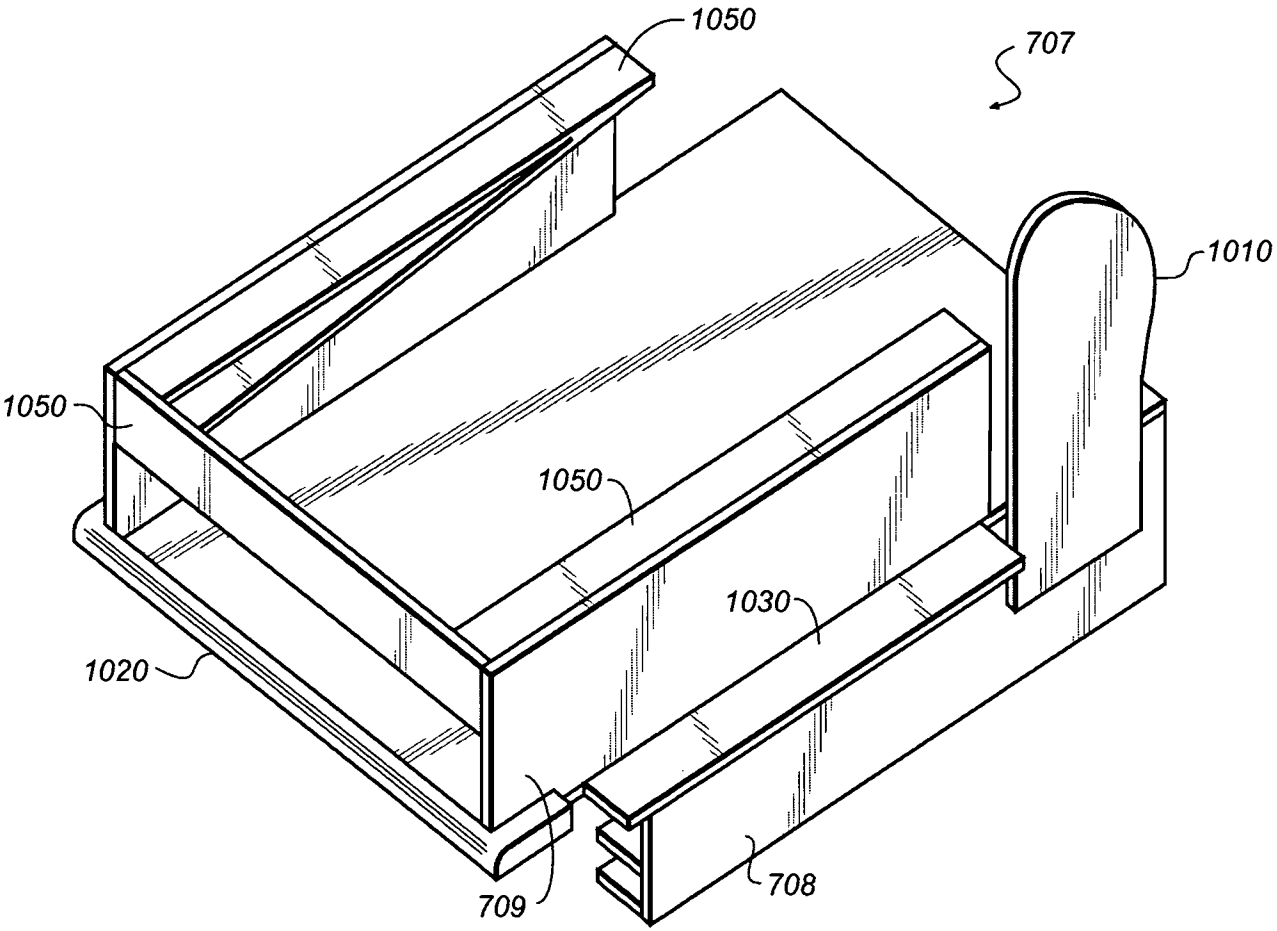
FIG. 10 is a pictorial illustrating the removable media receptacle adapted to fit inside a cut sheet receiving well of the receiver supply media cassette.

FIG. 10 shows the removable media receptacle 707 according to an aspect of the present invention. The removable media receptacle 707 includes at least one user accessible flexible member 1010 for permitting the user to flip the removable media receptacle 707 inside the cut sheet receiving well 920 of the media tray 910 after images have been formed on the first side of the cut sheet media 26 so that images can be formed on the second side of the cut sheet media 26. FIG. 10 also shows a stop 1020 that prevents the received cut sheet media 26 from being accidentally fed into the thermal printer 18 after the image has been formed on the cut sheet media 26. The removable media receptacle 707 further includes guides 1050 for directing the path of cut sheet media 26 from the first compartment 708 of the removable media receptacle 707 to the thermal printer 18 and from the thermal printer 18 to the second compartment 709 of the removable media receptacle 707. The removable media receptacle 707 can include an optional alignment member 1030 that can be used to stabilize the removable media receptacle 707 when it is placed inside the cut sheet receiving well 920 of the media tray 910.

Figure 11:
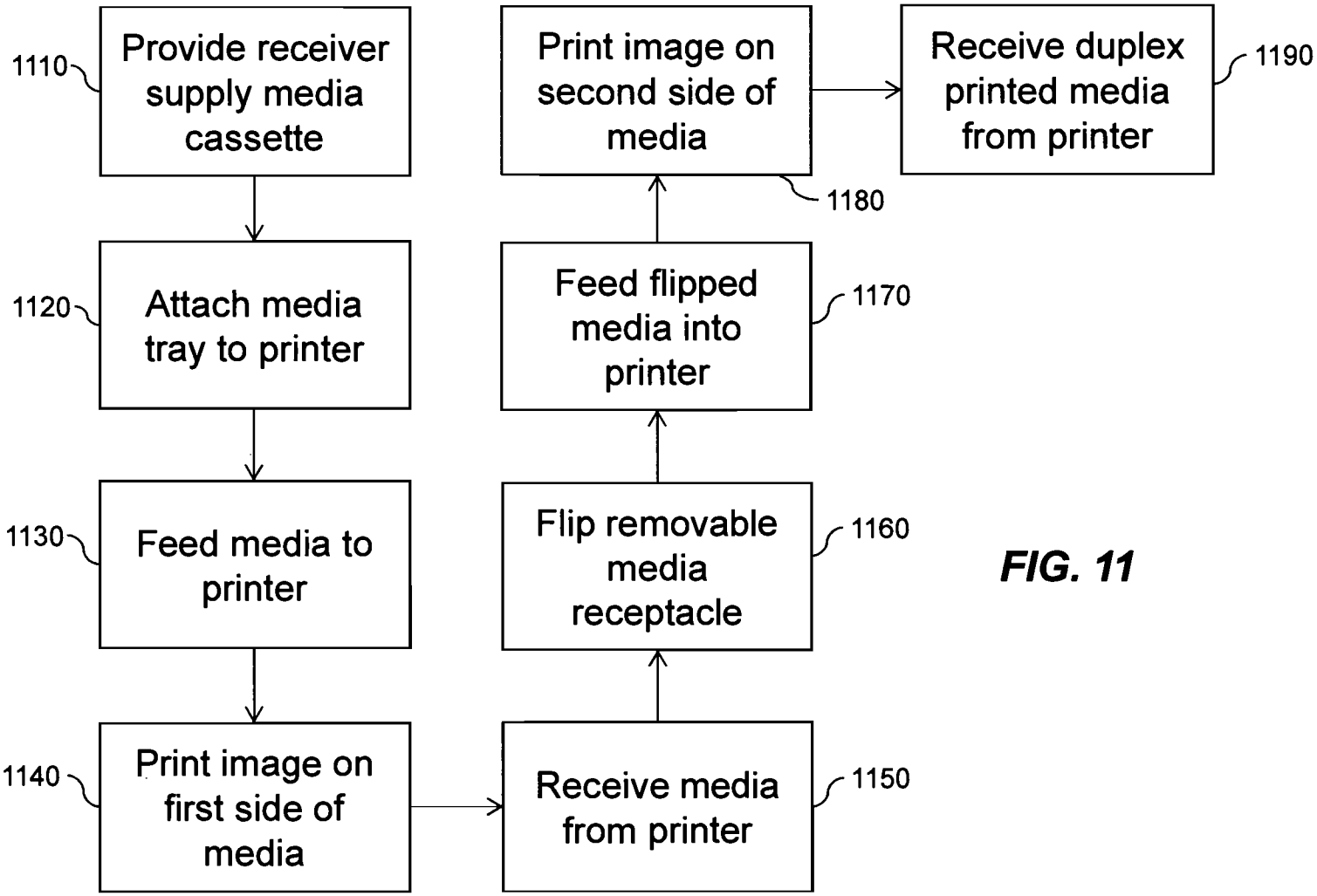
FIG. 11 is a flowchart showing a method for handling cut sheet media according to an aspect of the present invention.

FIG. 11 shows a flowchart describing a method for handling cut sheet media according to an aspect of the present invention. In step 1110, a receiver supply media cassette 44 comprising of the media tray 910 and the removable media receptacle 707 is provided to hold the cut sheet media 26. In step 1120, the receiver supply media cassette 44 is attached to the thermal printer 18 and cut sheet media 26 is fed from the first compartment 708 of the removable media receptacle 707 to the thermal printer 18 in step 1130. In step 1140, the thermal printer 18 prints a first image on the first side of the fed cut sheet media 26. The single side printed media is fed into the second compartment 709 of the removable media receptacle 707 in step 1150. In step 1160, the removable media receptacle 707 is flipped and replaced into the media tray 910. In step 1170, the cut sheet media 26 can be fed into the thermal printer 18 from the second compartment 709 of the removable media receptacle 707 to the thermal printer 18 to print the second image on the second side of the fed cut sheet media 26 using step 1180. The duplex printed cut sheet media 26 is fed from the thermal printer 18 into the first compartment 708 of the removable media receptacle 707 in step 1190.

The invention has been described in detail with particular reference to certain preferred embodiments thereof, but it will be understood that variations and modifications can be effected within the spirit and scope of the invention.

PARTS LIST

18 thermal printer
20 printer controller
22 thermal print head
22A thermal print head
22B thermal print head
26 receiver media
30 donor ribbon
30A donor ribbon
30B donor ribbon
32.1 donor patch set
32.2 donor patch set
34.1 yellow donor patch
34.2 yellow donor patch
36.1 magenta donor patch
36.2 magenta donor patch
38.1 cyan donor patch
38.2 cyan donor patch
40.1 clear donor patch
40.2 clear donor patch
41 receiver pick roller
42 receiver drive roller
43 receiver exit roller
44 receiver supply media cassette
45 ceramic substrate
46 platen roller
47 heat sink
48 donor ribbon take-up roll
49 thermal resistors
50 donor ribbon supply roll
52 image receiving area
54 peel member
56 idler roller
62 user input system
64 output system
68 memory
71 removable memory interface
72 hard drive
74 communication system
76 remote memory
80 sensor system
82 donor position sensor
84 receiver position sensor
86 movement sensor
88 follower wheel
90 heat sink
92 peel member
94 pinch roller
96 capstan roller
400 thermal printing system
410 duplex thermal printing system
420 duplex thermal printing system
421 receiver supply roll
422 first position
424 second position
430 duplex thermal printing system
432 cutter
433 cut receiver media
434 diverter
435 first position
436 second position
438 turn roller
439 guides
707 removable media receptacle
708 first compartment
709 second compartment
910 media tray
920 cut sheet receiving well
930 side wall
940 ramp
1010 flexible member
1020 stop
1030 alignment member
1050 guides
1110 provide receiver supply media cassette
1120 attach media tray to printer
1130 feed media to printer
1140 print image on first side of media
1150 receive media from printer
1160 flip removable media receptacle
1170 feed flipped media into printer
1180 print image on second side of media
1190 receive duplex printed media from printer
L patch set leading edge
LED donor patch leading edge
LER receiving area leading edge
T patch set trailing edge
TER receiving area trailing edge

The invention claimed is:

1. A method for handling cut sheet media in a receiver supply media cassette, comprising:

providing the receiver supply media cassette that includes a media tray with a removable media receptacle to hold the cut sheet media, wherein the removable media receptacle has a first compartment to hold cut sheet media to be fed into an imaging apparatus, and a second compartment to receive cut sheet media from the imaging apparatus;

attaching the media tray with the removable media receptacle to the imaging apparatus;

feeding the cut sheet media from the first compartment of the removable media receptacle to the imaging apparatus;

using the imaging apparatus to print a first image on a first side of the fed cut sheet media;

receiving the printed cut sheet media from the imaging apparatus into the second compartment of the removable media receptacle;

flipping the removable media receptacle;

feeding the cut sheet media from the second compartment of the removable media receptacle to the imaging apparatus;

using the imaging apparatus to print a second image on a second side of the fed cut sheet media; and receiving the printed cut sheet media from the imaging apparatus into the first compartment of the removable media receptacle.

2. The method of claim 1 further including providing at least one flexible member on the removable media cassette for grasping the removable media receptacle to permit a user to flip the removable media receptacle after the first image has been formed on the first side of the cut sheet media.

3. The method of claim 2 further including providing a stop on the removable receiver supply media cassette to prevent the received media from being accidentally fed into the imaging apparatus.

4. The method of claim 2 further including providing guides on the first or second compartment of the removable receiver supply media cassette.

5. The method of claim 2 further including providing an alignment member on the removable receiver supply media cassette to stabilize the removable media receptacle when it is placed inside the cut sheet receiving well of the media tray.

* * * * *